US008292396B2

(12) United States Patent
Yamada

(10) Patent No.: US 8,292,396 B2
(45) Date of Patent: Oct. 23, 2012

(54) IMAGE FORMING APPARATUS WHICH ADJUSTS INK TEMPERATURE

(75) Inventor: Takahisa Yamada, Hachioji (JP)

(73) Assignee: Riso Kagaku Corporation, Tokyo (JP)

( * ) Notice: Subject to any disclaimer, the term of this patent is extended or adjusted under 35 U.S.C. 154(b) by 207 days.

(21) Appl. No.: 12/794,834

(22) Filed: Jun. 7, 2010

(65) Prior Publication Data

US 2010/0309244 A1 Dec. 9, 2010

(30) Foreign Application Priority Data

Jun. 9, 2009 (JP) ..... 2009-138464

(51) Int. Cl.
*B41J 29/38* (2006.01)

(52) U.S. Cl. ..... 347/17

(58) Field of Classification Search ..... 347/17, 347/18

See application file for complete search history.

(56) References Cited

U.S. PATENT DOCUMENTS

| | | | | |
|---|---|---|---|---|
| 5,367,325 | A * | 11/1994 | Yano et al. | 347/17 |
| 7,815,277 | B2 * | 10/2010 | Yamada | 347/17 |
| 8,070,248 | B2 * | 12/2011 | Ogama | 347/14 |

FOREIGN PATENT DOCUMENTS

| | | | |
|---|---|---|---|
| JP | 10-086405 | A | 4/1998 |
| JP | 2006-199021 | A | 8/2006 |
| JP | 2009-45905 | A | 3/2009 |

* cited by examiner

*Primary Examiner* — An Do
(74) *Attorney, Agent, or Firm* — Holtz, Holtz, Goodman & Chick, PC

(57) ABSTRACT

An image forming apparatus estimates a temperature at nozzles in consideration of temperature changes in a recording head, by temperature sensors provided at an ink supply port and an ink eject port in the recording head. From the estimated temperature and a temperature difference between when feeding ink and when ejecting ink, a temperature control based on heating/cooling is performed by combining a fan and a heater with heating/cooling based on the peltier element, so as to fall within a drivable temperature range in which the nozzles properly discharge ink.

5 Claims, 8 Drawing Sheets

| | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|
| Higher than T3 | 114 ,115 | | | | | | | | 114 | 114 | 114 | 115 | 115 | 115 | |
| Between T3 and T2 | | 114 =115 | 114-115> α | 115-114> α | \|115-114\| <= α | 114 | 115 | | 114-115> α | \|115-114\| <= α | | 115-114> α | \|115-114\| <= α | | 115 |
| T2 or less | | | | | | 115 | 114 | 114 ,115 | | | 115 | | | 114 | 114 |
| Cooling by peltier element 32 | ○ | | ○ | | | | | | ○ | ○ | ○ | * | * | | |
| Heating by peltier element 32 | | | | ○ | | * | ○ | ○ | | | | | | ○ | ○ |
| Fan 201 ON | ○ | | | ○ | | | | | * | * | | ○ | ○ | ○ | |
| Heater 203 ON | | | ○ | | | ○ | * | ○ | | | ○ | | | | * |

FIG. 10

IMAGE FORMING APPARATUS WHICH ADJUSTS INK TEMPERATURE

CROSS-REFERENCE TO RELATED APPLICATIONS

This application is based upon and claims the benefit of priority from prior Japanese Patent Application No. 2009-138464, filed Jun. 9, 2009, the entire contents of which are incorporated herein by reference.

BACKGROUND OF THE INVENTION

1. Field of the Invention

The present invention relates to an image forming apparatus which forms images with high image quality by properly estimating an ink temperature at nozzles of a recording head.

2. Description of the Related Art

In general, there is a known image forming apparatus which discharges ink to a recording medium such as a recording paper sheet, namely, an inkjet printer. The image forming apparatus has a recording head which discharges ink by driving an actuator constituted by a piezoelectric element or a heater element. When the actuator is driven, the actuator generates heat not only from the actuator itself but also from a driving section (drive IC) for the actuator. If the image forming apparatus is modified to employ an increased number of nozzles to increase recording speeds and to employ a line-type recording head, an amount of heat generated from the nozzles increases.

As a measure to restrict the apparatus from heating too highly, for example, Jpn. Pat. Appln. KOKAI Publication No. 2006-199021 has proposed a technique of propagating generated heat to ink by providing a eject path (ink feedback path) in an ink feed path including a recording head.

Ink used in image forming apparatus has a viscosity which decreases in accordance with increase in ink temperature, regardless of types of the ink. Therefore, if the recording head is driven by the same drive voltage as under a low temperature when the ink temperature has increased very high, an amount of discharged ink (namely, a drop volume amount) increases and thereby denses colors of images or bleeds. That is, if the temperature of a driven recording head rises high, the ink temperature of ink inside the recording head also rises. If the recording head is still driven at the constant drive voltage, image quality of formed images (or quality of printed characters) changes and, image quality cannot be maintained constant.

Hence, the recording head drive voltage need to be corrected. For example, according to Jpn. Pat. Appln. KOKAI Publication No. 2006-199021, a temperature sensor is provided in a downstream side of a recording head along an ink circulation path for cooling the recording head, to detect an ink temperature. A drive voltage of the recording head is corrected by using a detected value thereof. Further, another temperature sensor is provided in an upstream side of the recording head along the ink circulation path, to adjust the ink temperature of ink supplied to the recording head.

Usually, temperatures of a recording head or nozzles cannot be correctly estimated by a mere temperature control with use of only ink temperatures in an upstream or downstream side of the recording head.

Reasons thereof will now be described below. FIG. 11A and FIG. 11B graphically represent temperature characteristics of ink flowing through the recording head. The recording head is provided on an ink circulation path. The vertical axes in FIG. 11A and FIG. 11B represent temperatures of ink, and the horizontal axes thereof represent time from when ink supplied from an ink path in the upstream side flows into the recording head to when ink not used (or not discharged) is ejected to the ink path in the downstream side.

Between FIG. 11A and FIG. 11B, ink temperatures in the upstream side of the recording head are equal. FIG. 11A particularly represents an example in which the ink temperature in the downstream side of the recording head is high. In contrast, FIG. 11B represents an example in which the ink temperature in the downstream side of the recording head is low. Here, TC denotes an ink temperature at nozzles when the ink temperature in the downstream side of the recording head is high. TD denotes an ink temperature at the nozzles when the ink temperature in the downstream side of the recording head is low. Further, the nozzles are supposed to exist in the substantial center of a segment from a point where ink flows into the recording head to a point where the ink flows out.

As is obvious from FIG. 11A and FIG. 11B, the ink temperature in the downstream side of the recording head cannot be known by only detecting the ink temperature in the upstream side of the recording head, in both figures. Therefore, even if the ink temperature in the upstream side of the recording head stays equal, by what degrees ink changes inside the recording head cannot be known. This is because the recording head itself serves as a heating source or a heat radiation source depending on whether the recording head is driven or not driven. As ink flowing through such a recording head is ejected, the ink receives heat from the recording head in some cases, thereby increasing the ink temperature, or the recording head deprives the ink of heat in some other cases, thereby decreasing the ink temperature.

A difference in temperature of the recording head is a difference between the ink temperatures in the upstream and downstream sides of the recording head. Therefore, unless the difference in temperature is unknown, an actual temperature of the recording head (particularly at the nozzle) cannot be known. As represented also in FIG. 11A and FIG. 11B, the ink temperatures TC and TD at the nozzles depend on the ink temperature in the downstream side of the recording head. Consequently, the ink temperature at the nozzles cannot be accurately estimated only from the ink temperature in the upstream side of the recording head.

Therefore, even if an ink temperature at the nozzles is calculated (estimated) based on only one of the ink temperatures in the upstream and downstream sides of the recording head, the calculated ink temperature greatly deviates from an actual ink temperature because a temperature difference by which an ink temperature changes inside the recording head is unknown. Therefore, an ink temperature at which ink can be discharged cannot be said to have been reached. As a result, the amount of ink discharged from the nozzle becomes improper and causes a deterioration of image quality.

Hence, the present invention is directed to providing of an image forming apparatus capable of forming high quality images on recording media by estimating an ink temperature at nozzles in a recording head with improved accuracy and by accordingly optimizing an ink discharge amount of ink to be discharged from the recording head.

BRIEF SUMMARY OF THE INVENTION

According to an embodiment of the present invention, there is provided an image forming apparatus comprising: a recording head comprising a plurality of nozzles which discharge ink; a circulation path which comprises a feed path for feeding ink to the recording head and a eject path for ejecting the ink from the recording head, and feeds the ink flowing through the eject path again to the recording head through the feed path; a first temperature detection section provided in a side of the feed path; a second temperature detection section provided in a side of the eject path; and an ink temperature adjustment means which controls temperatures of the ink, wherein the ink temperature adjustment means calculates an ink temperature at nozzles, based on an output from the first temperature detection section and an output from the second temperature detection section, and adjusts ink temperatures such that the calculated ink temperature falls within a temperature range in which the ink can be discharged.

Advantages of the invention will be set forth in the description which follows, and in part will be obvious from the description, or may be learned by practice of the invention. Advantages of the invention may be realized and obtained by means of the instrumentalities and combinations particularly pointed out hereinafter.

BRIEF DESCRIPTION OF THE SEVERAL VIEWS OF THE DRAWINGS

The accompanying drawings, which are incorporated in and constitute a part of the specification, illustrate embodiments of the invention, and together with the general description given above and the detailed description of the embodiments given below, serve to explain the principles of the invention.

FIG. 10 is a table representing examples of temperature controls in Cases 1 to 15.

DETAILED DESCRIPTION OF THE INVENTION

Hereinafter, an embodiment of the present invention will be described in details below with reference to the drawings.

Figure 1:
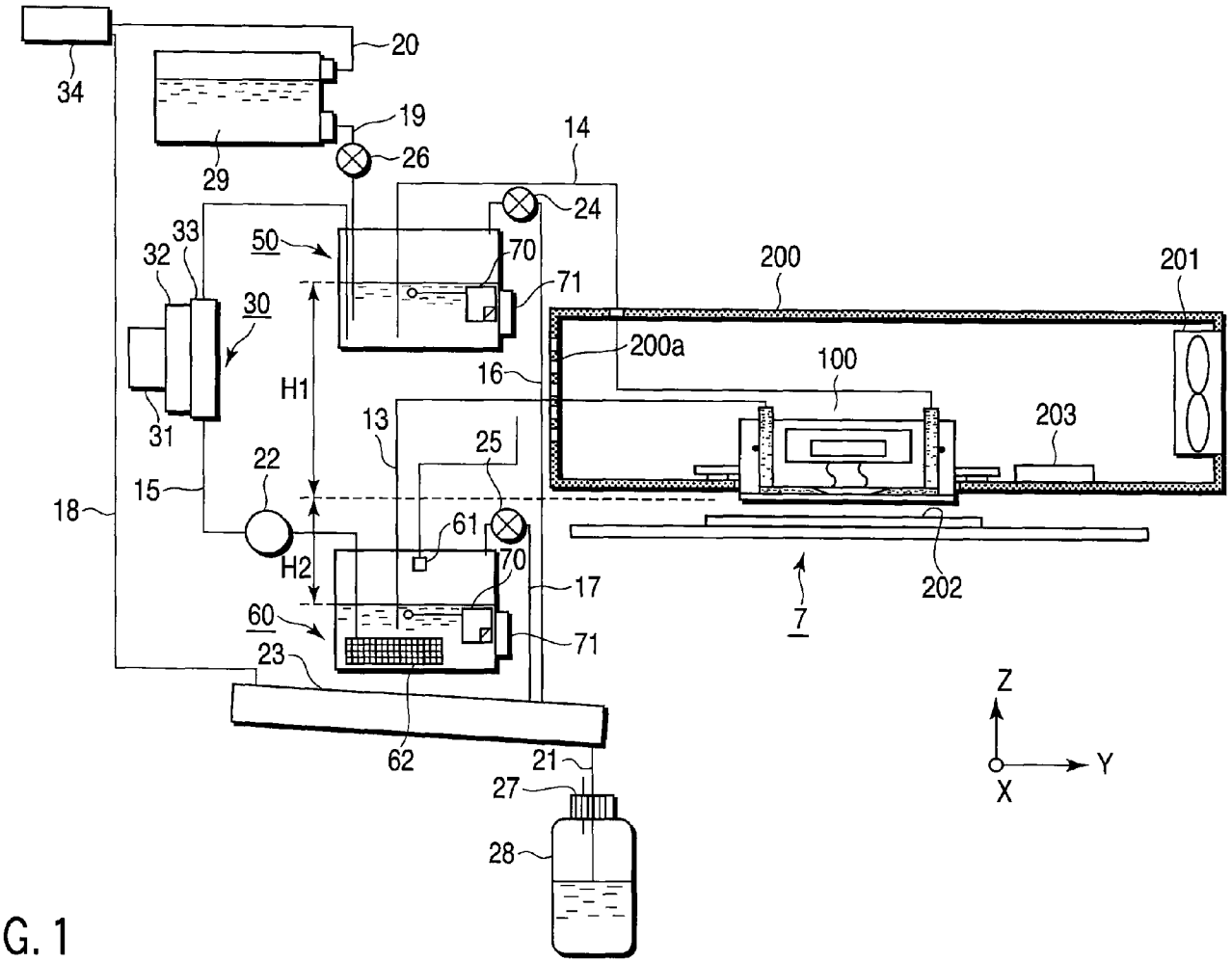
FIG. 1 illustrates a configuration example of an ink circulation path in an image forming apparatus according to the first embodiment.
Figure 2:
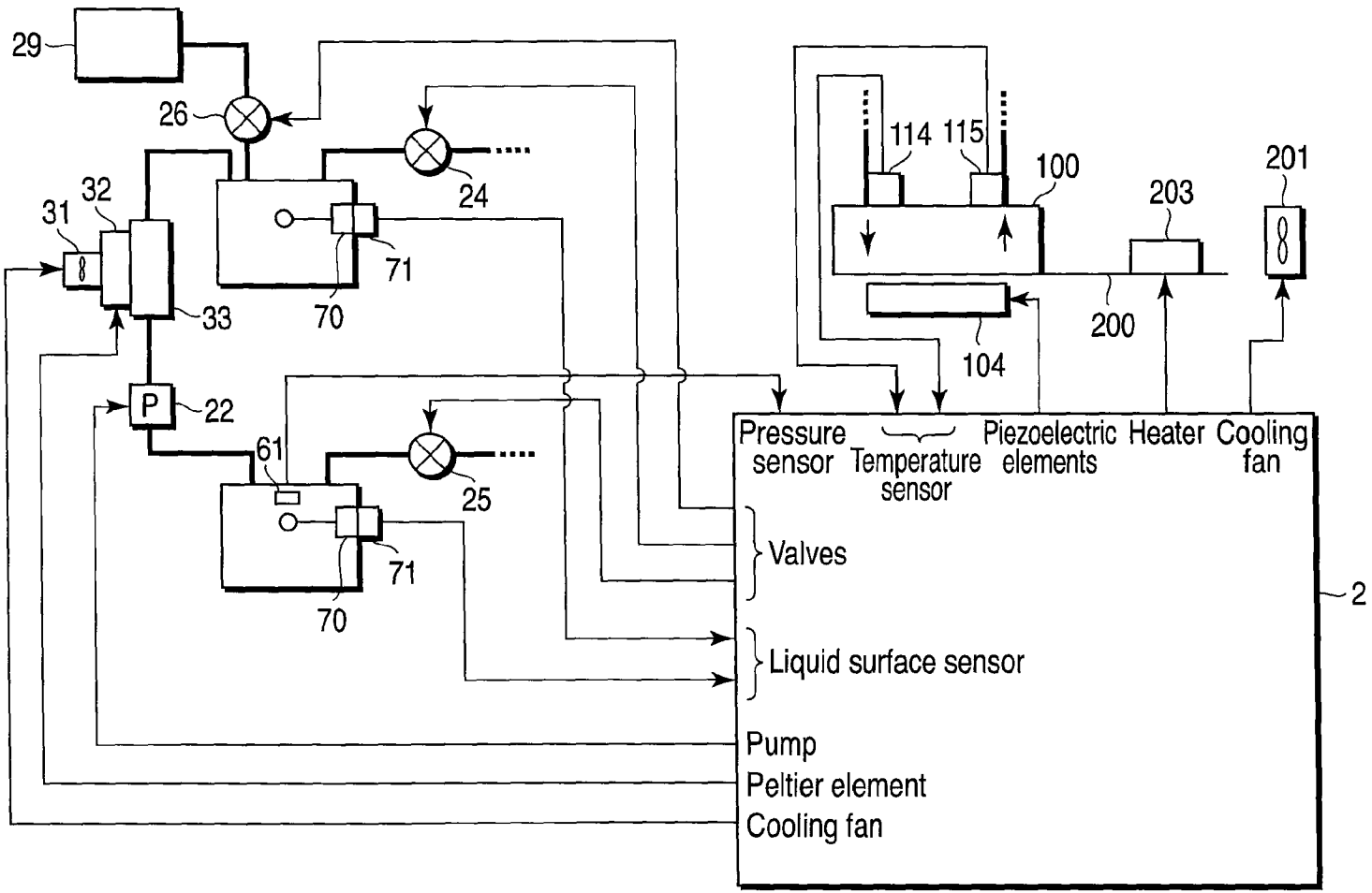
FIG. 2 illustrates a control system concerning constitutive portions of the ink circulation path according to the embodiment.

FIG. 1 illustrates a configuration example of an ink circulation path 1 in an image forming apparatus according to the first embodiment. FIG. 2 is a diagram illustrating a constitutive portion of the ink circulation path 1 according to the present embodiment. FIG. 1 illustrates a simplified configuration of the invention to help easy understanding of the invention. It has plural recording heads provided for every ink color, and the ink circulation paths in which only the number of ink colors was formed at least, in an actual configuration. FIG. 1 shows the recording head and ink circulation path of one ink classification by color of these. Only one recording head and one ink circulation path are illustrated although plural recording heads are provided respectively for a number of ink colors and at least a number of ink circulation paths equal to the number of ink colors are provided, in an actual configuration.

The ink circulation path 1 in the present embodiment is constituted by main ink paths, i.e., an ink feed path 14, an ink eject path 13, an ink feedback path 15, an ink charge path 19, and a drain path 21. These paths are constituted so as to connect constitutive portions described below, by using pipe members made of resin or metal. Further, as illustrated in FIG. 2, electric constitutive portions such as sensors and electromagnetic valves are all controlled to be driven by a control section 2.

The ink feed path 14 is connected from an upstream sub-tank 50 as an ink supply source to an ink supply port 107 in the recording head 100 provided in a recording head module 100. The ink discharge path 13 is connected from an ink eject port 108 of the recording head 100 to a downstream sub-tank 60. Further, the ink feedback path 15 is connected from the downstream sub-tank 60 to the upstream sub-tank 50 through a pump 22 which pumps up ink and a heat exchanger 30 which adjusts temperatures of ink.

Further, the upstream sub-tank 50 and the downstream sub-tank 60, an actuator 70 for detecting a liquid surface in the tank is attached to be swing-able about a fulcrum which is an end of the actuator 70. In the opposite end side to the fulcrum of swinging of the actuator 70, there is provided a float containing air, and a magnet is attached to the float. Outside each of the sub-tanks, there is provided a liquid surface sensor 71 comprising a lead switch at a position of the float where the float is opposed to the magnet. The actuator 70 which swings depending on the liquid surface level of ink detects the liquid surface level.

In the present embodiment, the upstream sub-tank 50 is designed to have a liquid surface which is positioned higher by approximately 100 mm than a nozzle surface 101*a* of the recording head 100. Similarly, the downstream sub-tank 60 is designed to have a liquid surface which is positioned lower by approximately 50 mm than the nozzle surface 101*a* of the recording head 100. To upper sides of the sub-tanks 50 and 60 where air is retained in the sub-tanks, one ends of open-air paths 16 and 17 are connected through valves 24 and 25. The other ends thereof are connected to an overflow path 23. The valve 24 is constituted by, for example, an electromagnetic valve, and is of a normal close type which shuts off (closes) a path when electric power is off. Similarly, the valve 25 is also constituted by, for example, an electromagnetic valve, and is of a normal open type which connects (opens) a path when electric power is off.

The overflow path 23 is configured to have a larger cross-sectional area than other paths. As illustrated in FIG. 1, the overflow path 23 is inclined at approximately 5 degrees relative to the Z-direction. To an upper surface thereof in the highest side, an end of an open-air path 18 is connected. To a lower surface thereof in the lowest side, the drain path 21 is connected. The drain path 21 is connected to a drain bottle 28 provided in a lower side along the ink circulation path 1, as illustrated in FIG. 1. Inside of the drain bottle 28 is open to an air pressure through an open-air path 27. In the present embodiment, the drain bottle 28 is provided in a lower side of a device frame of the image forming apparatus.

An ink bottle 29 is provided to be positioned above the upstream sub-tank 50 (in the Z-axis direction), and is connected to the ink charge path 19 through the valve 26. The valve 26 is constituted by, for example, an electromagnetic valve and is of a normal close type. In the present embodiment, the ink bottle 29 is provided near an upper cover of the device frame of the image forming apparatus, so as to be easily replaced for charging ink.

To an upper surface of the ink bottle 29, an open-air path 20 for introducing outside air is connected, and an air filter 34 is provided at an open end thereof. Further, the air filter 34 is also connected to an open end side of the open-air path 18. This filter has a mesh size of approximately 5 μm and prevents dust contained in outside air from entering into ink paths.

The heat exchanger 30 provided on the ink feedback path 15 comprises a heat exchange path section 33, a peltier element 32, and a fan 31. The heat exchange path section 33 is made of a material having an excellent heat conductivity, such as aluminum, copper, or stainless steel. Ink flows inside the heat exchange path section 33. The peltier element 32 is in tight contact with the heat exchange path section 33, to exchange heat with the ink. The fan 31 is to radiate, for example, waste heat of the peltier element 32 to outside.

Further, an end of the ink feedback path 15 is inserted into the downstream sub-tank 60, and a draw port thereof is connected to the ink filter 62 which sinks in ink near a bottom of the sub-tank.

When ink in the downstream sub-tank 60 is pumped up by the pump 22, the ink passes through the ink filter 62 from the draw port, and is thereby filtered by the ink filter 62. Further, a temperature adjustment is performed by exchanging heat at the heat exchanger 30, and is then drawn up to the upstream sub-tank 50. In the present embodiment, a diaphragm type pump which is driven by a pulse motor is used as the pump 22. A pulse motor mounted on an unillustrated drive board can be subjected to a rotation control by a rotation speed control circuit, so as to adjust an ink flow rate at which ink is drawn up by the upstream sub-tank 50.

Further, a pressure sensor 61 is provided to measure a pressure at an air layer part in the downstream sub-tank 60. By driving the pump 22 with an air release valve 25 of the downstream sub-tank 60 closed, the pressure inside the downstream sub-tank 60 is made negative. The pump 22 is controlled by the rotation speed of the aforementioned pulse motor so that the negative pressure is equal to a predetermined value. That is, when the negative pressure is desirably to be increased, the pulse motor is controlled to rotate faster. When the negative pressure is desirably to be decreased, the pulse motor is controlled to rotate slower.

Figure 3:
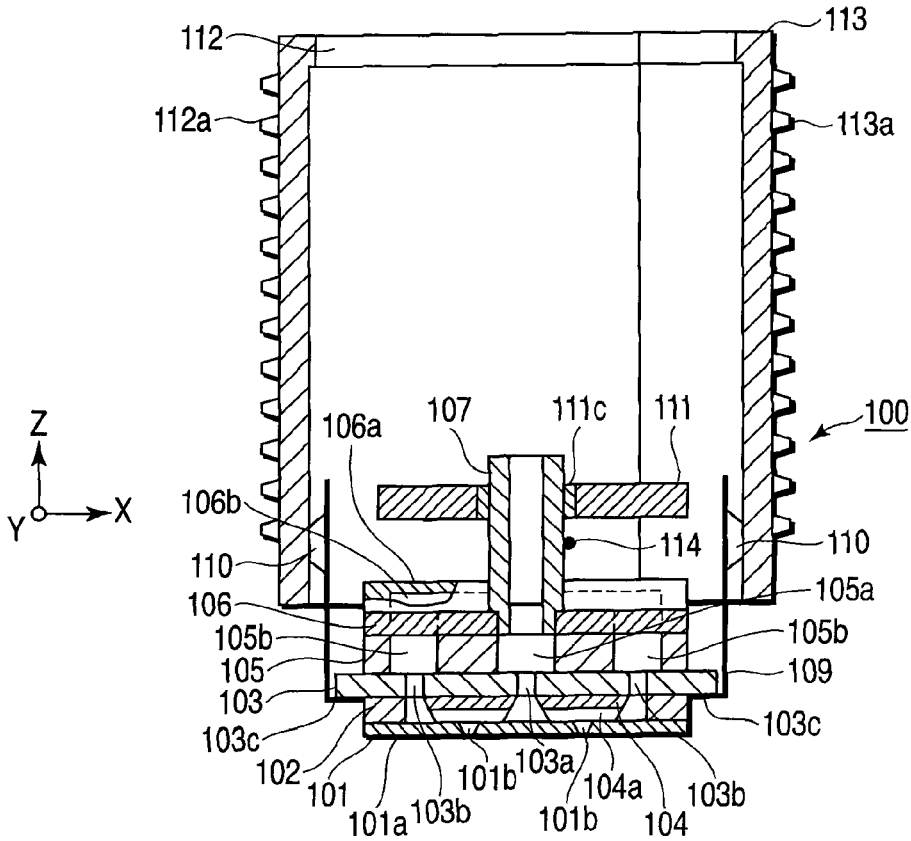
FIG. 3 illustrates a cross-sectional configuration of a recording head 100 including a head heat sink.
Figure 4:
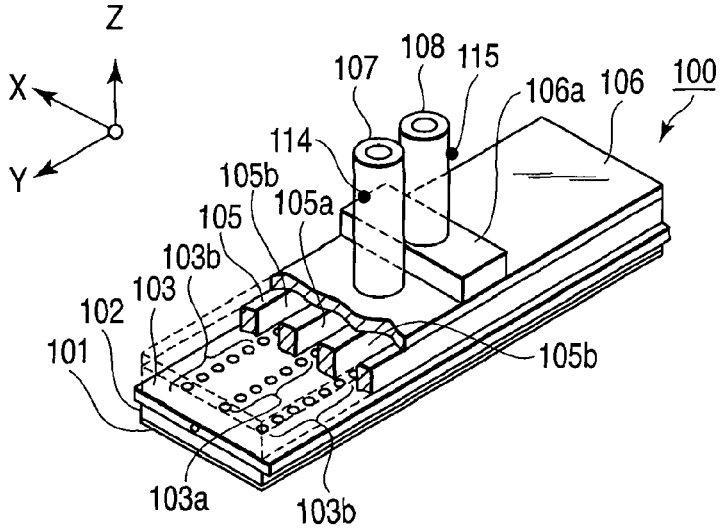
FIG. 4 illustrates an exterior configuration of the recording head viewed obliquely from upside, partially including an interior structure.

Next, an interior structure of the recording head 100 will be described with reference to FIG. 3 and FIG. 4. FIG. 3 illustrates a cross-sectional configuration of a recording head 100, including a head heat sink (covers). FIG. 4 is a view illustrating an exterior configuration including a part of an interior structure, wherein the recording head 100 is viewed obliquely from upside.

As illustrated in FIG. 3, in the recording head 100, a frame 102 which includes a hollow center part and peripherally surrounds a base 103 is bonded to one surface side of the base 103. In the hollow part, paired piezoelectric elements 104 are also bonded to the one surface side of the of the base 103. The piezoelectric elements 104 and the frame 102 are bonded with a nozzle plate 101 layered on the frame 102 and the piezoelectric elements 104 in the Z-direction, so as to close the hollow center part at an equal level.

Plural grooves are cut in the piezoelectric elements 104 so as to be tapered in the X-axis direction. The grooves form channels 104*a*. Further, nozzles 101*b* for discharging ink are provided in a nozzle plate surface 101*a*, so as to overlap center parts of the grooves.

As also illustrated in FIG. 3, the channels 104*a* are formed in a manner that plural channels are arranged in parallel in the Y-axis direction. The plural nozzles 101*b* are also arranged in the Y-axis direction in correspondence with the channels.

In the present embodiment, the grooves are provided at a pitch of approximately 170 μm and are shaped to be about 85 μm wide and 300 μm deep. The paired two piezoelectric elements 104 are arranged, shifted by a half pitch in the y-axis direction as illustrated in FIG. 3.

In the base 103, plural holes 103*a* are arranged along the Y-axis direction in each of the respective centers of the paired piezoelectric elements 104. Here, the holes 103*a* are through holes having a diameter of about 1 mm and are provided at an interval of 3 mm maintained between each other. Similarly, holes 103*b* are provided at positions corresponding to gaps between the frame 102 and the piezoelectric elements 104, along the X-axis direction.

To the other surface of the base 103, a path member 105 and a path member 106 are bonded, layered in the Z-axis direction. At least three parallel grooves are provided in the path member 105.

A forward path 105*a* is positioned to be opposed to the holes 103*a*, and return paths 105*b* are positioned to be opposed to the holes 103*b*. The path member 106 is bonded so as to cover the three grooves. This path member 106 is provided with the pipe-like ink supply port 107 and the ink eject port 108.

The hole of the ink supply port 107 is connected to the forward path 105*a*. The hole of the ink eject port 108 is connected to a joint path 106*b* which bridges the two return paths 105*b* inside a convex part 106*a* of the path member 106.

Flows of ink in the recording head 100 in a configuration as described above will now be described.

Ink supplied from the upstream sub-tank 50 flows through the ink feed path 14, and further flows into the recording head 100 through ink supply port 107. Ink in the recording head 100 passes through the path 105*a* and spreads throughout the whole width of the recording head in the Y-axis direction. That is, the ink is supplied to the whole centers of the paired piezoelectric elements 104 from the plural holes 103*a*.

The supplied ink is branched to areas where the respective piezoelectric elements 104 are formed, and further reaches gaps between the frame 102 and the piezoelectric elements 104, through insides of the plural channels 104*a*. Thereafter, the ink further passes through the two return paths 105*b* from the holes 103*b*, and is merged by the joint path 106*b*. Then, the ink is ejected to outside from the ink eject port 108. The ink ejected from the ink eject port 108 flows into the ink eject path 13 and further into the downstream sub-tank 60. Thus, the ink flows into the recording head module 100 through the ink feed path 14 from the upstream sub-tank 50, and further reaches the downstream sub-tank 60 through the ink eject path 13.

Electrode wires of the channels 104*a* of the recording head 100 are connected to a FPC 109 through an electrode contact surface 103*c* of the base 103. A drive IC 110 is mounted on the FPC 109, and performs driving by apply a voltage waveform to each of the channels. The base 103 of the recording head 100 is preferably made of metal which has a much higher heat conductivity than the piezoelectric elements. The ink supply port 107 and ink eject port 108 are respectively provided with a temperature sensor 114 (first temperature detection section) and a temperature sensor 115 (second temperature detection section) both of which are thermistors.

The ink supply port 107 and ink eject port 108 penetrate through holes 111*c* and 111*d* provided in a fixing member 111, and are bonded at the penetrating parts to be integral with the fixing member 111. The fixing member 111 is integrally fixed, by screwing, to a recording head cover 113 which functions as a heat sink, at two end portions. Covers 112 and 113 are combined together into a box-like shape which covers the ink supply port 107, ink eject port 108, and drive IC 110 in the recording head 100.

Figure 5:
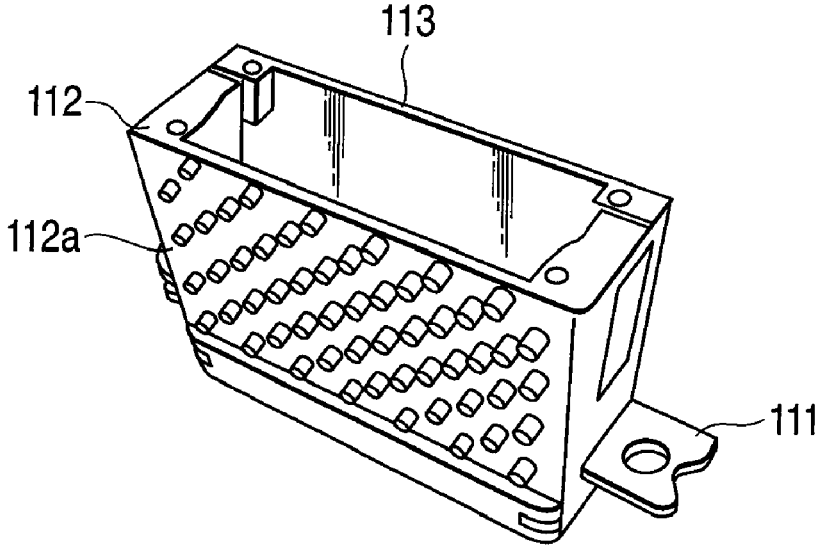
FIG. 5 illustrates an exterior configuration of head covers which function as a heat sink attached to the recording head.
Figure 6:
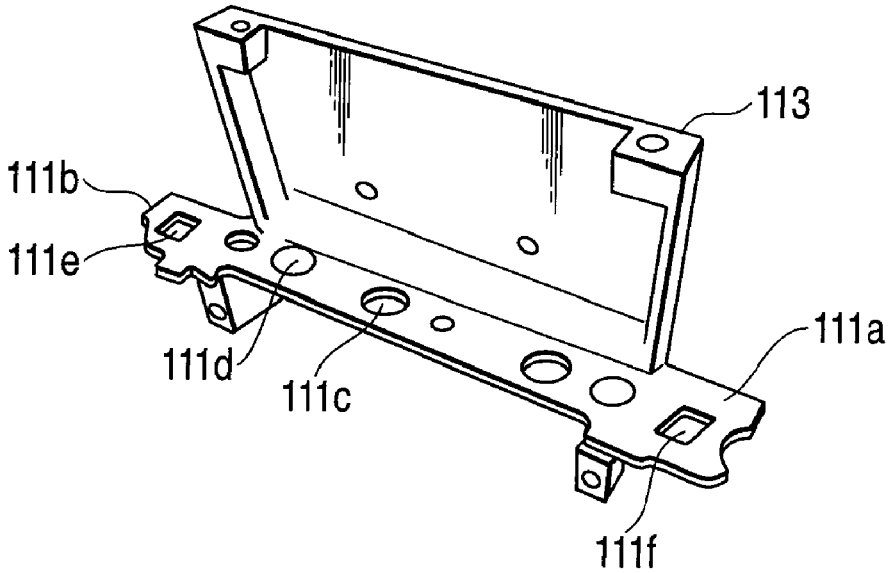
FIG. 6 illustrates an exterior configuration of a recording head cover integrated by screwing.

FIG. 5 illustrates an exterior configuration of the separate covers 112 and 113 to be attached to the recording head 110, wherein the covers are combined.

As illustrated in FIG. 3, the drive IC 110 is pressed into tight contact with inner surface sides of the covers 112 and 113 by an elastic member such as an unillustrated spring. Parts making the tight contact are applied with known grease having an excellent heat conductivity in order to improve contact tightness.

Since the ink supply port 107 and ink eject port 108 are pipes made of a material having an excellent heat conductivity, outputs (detected temperatures) of the temperature sensors 114 and 115 are values which are substantially equal to a temperature of ink flowing through the pipes. As described previously, a viscosity of ink varies depending on temperatures. Therefore, in order to constantly discharge ink of an equal volume, a voltage applied to piezoelectric elements need be controlled to a voltage which is suitable for the viscosity of the ink.

An ink temperatures at part of the piezoelectric elements is difficult to directly detect. Therefore, controls are performed estimating that this ink temperature is substantially an average of temperatures detected by the temperature sensors 114 and 115.

If the piezoelectric elements 104 are driven to discharge ink from the nozzles 101*b*, the piezoelectric elements themselves generate heat. A part of the heat transfers to the discharged ink and is radiated outside of the recording head 100. Further, another part thereof transfers to the base 103 and is radiated to outside of the recording head 100. Most of the remaining part of the heat is accumulated in the base 103 and the path members 105 and 106.

In order to prevent the temperature of the recording head 100 from increasing, the recording head 100 is designed as follows. That is, ink is let flow from the ink supply port 107 of the recording head 100, and excessive heat is let transfer to a portion of ink which has not been discharged when this portion of ink is ejected from the ink eject port 108. Thereafter, the excessive heat is radiated to outside. Further, the drive IC 110 also generates heat when the piezoelectric elements 104 are driven. This heat is thermally conducted to the covers 112 and 113. A large number of heat radiation protrudes 112*a* and 113*a* are provided on outer surfaces of the covers 112 and 113. These protrudes are to enlarge a surface area exposed to air around the recording head 100, to improve heat radiation effects.

The fixing member 111 is fixed to a recording head holder 200 by screwing through holes 111*e* and 111*f* at two ends of the fixing member 111.

Figure 7:
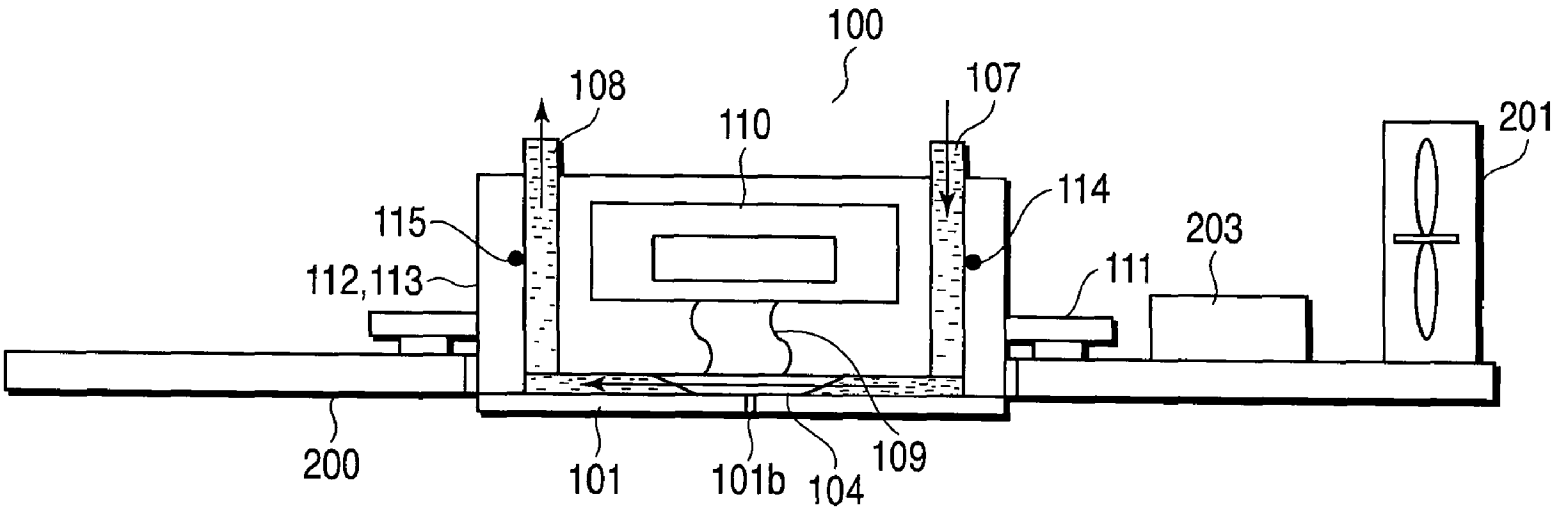
FIG. 7 schematically illustrates a state in which the recording head is fixed to the recording head holder.

FIG. 7 schematically illustrates the recording head 100 fixed to the recording head holder 200. The recording head holder 200 is provided with a heater 203 and a fan 201 near the recording head 100. The heater 203 operates to heat the recording head holder, and the fan 201 operates to air-cool the recording head holder 200 and recording head 100. The present embodiment comprises, as an ink temperature adjustment means, at least the heater 203, fan 201, fan 31 and peltier element 32.

Next, ink circulation operation in the ink circulation path will be described.

As illustrated in FIG. 1, when the recording head 100 stops, the valve 25 in the open-air path 17 is open. Therefore, inside of the downstream sub-tank 60 communicates with the overflow path 23, air outlet path 18, and air filter 34 and is opened to air. Further, inside of the upstream sub-tank 50 is sealed because the valve 24 is closed.

Accordingly, the ink liquid surface of the downstream sub-tank 50 is lower by approximately 50 mm than the nozzle surface 101*a* of the recording head 100. Menisci are formed in the nozzles 101*b* by a negative pressure, and ink does therefore not drop out of the recording head 100.

As a preparation for starting image forming on a recording medium 202, the valves 24 and 25 and the pump 22 are simultaneously driven first. As a result, with the valve 25 opened, the pump 22 is driven, and accordingly, the pressure of inner air inside the downstream sub-tank 60 changes from an atmospheric pressure to a negative pressure. On the contrary, in the side of the upstream sub-tank 50, the valve 24 is closed, and the ink liquid surface is positioned higher by approximately 100 mm than the nozzle surface 101*b*. Therefore, the nozzle surface receives a positive pressure.

As has been described previously, the pump 22 is controlled so as to adjust the internal pressure of the downstream sub-tank 60 to a predetermined pressure. Therefore, a predetermined negative pressure is reached rapidly. Provided that ink has a specific gravity of 1 g/cm3, pressures are considered in relation to the nozzle surface 101*a* as a reference. Then, a positive pressure of 1 kPa is applied due to the liquid surface level in the upstream sub-tank, and −0.5 kPa is applied due to the liquid surface of the downstream sub-tank. If a negative pressure of internal air inside the downstream sub-tank which is generated by the pump 22 is −3.5 kPa, a pressure difference between the upstream sub-tank 50 and the downstream sub-tank 60 is 5 kPa as a total. Resistance of paths in the upstream side of the nozzles 101*b* is equal to resistance of paths in the downstream side thereof, a pressure to the nozzles 101*b* is calculated to be −1.5 kPa.

The ink menisci of the nozzles 101*b* of the recording head 100 stay unbroken up to a certain negative pressure, owing to surface tension of ink and the hole diameter of the nozzles. Therefore, air is prevented from entering from the nozzles 101*b* and ink is prevented from leaking, by controlling driving of the pump 22 so as to maintain the negative pressure within the certain negative pressure. Ink flows from the upstream sub-tank 50 to the downstream sub-tank 60 through each of the recording head modules 100*a* to *f*. Ink is returned by the pump 22 from the downstream sub-tank 60 to the upstream sub-tank 50 through the ink feedback path 15.

With ink circulated in such an ink circulation path 1 as described above, a recording medium 202 is fed onto a driven belt conveyor unit 7 from an unillustrated sheet feed mechanism. When the conveyed recording medium 202 passes in front of the nozzles of the recording head 100, ink drops are discharged thereby to form an image.

As ink is consumed by discharge, the liquid surface in the upstream sub-tank 50 lowers, and the liquid surface sensor 71 detects lowering of the ink liquid surface. In this case, the valve 26 is opened to charge the upstream sub-tank with ink from the ink bottle 29. Owing to a difference between the liquid surfaces, ink is charged from the ink bottle 29 to the upstream sub-tank by dead weight of the ink.

Figure 8:
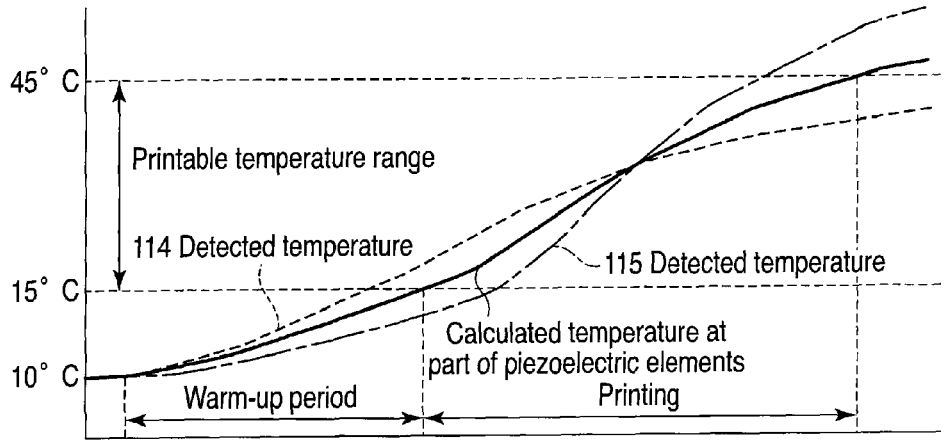
FIG. 8 is a graph representing an example in which only ink temperatures are controlled in the embodiment.
Figure 9:
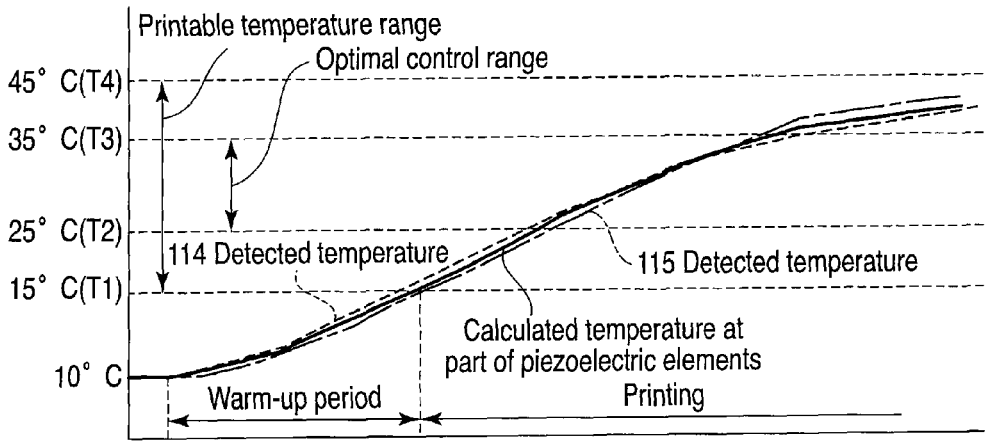
FIG. 9 is a graph representing temperature characteristics under a temperature control in the embodiment.
Figure 11B:
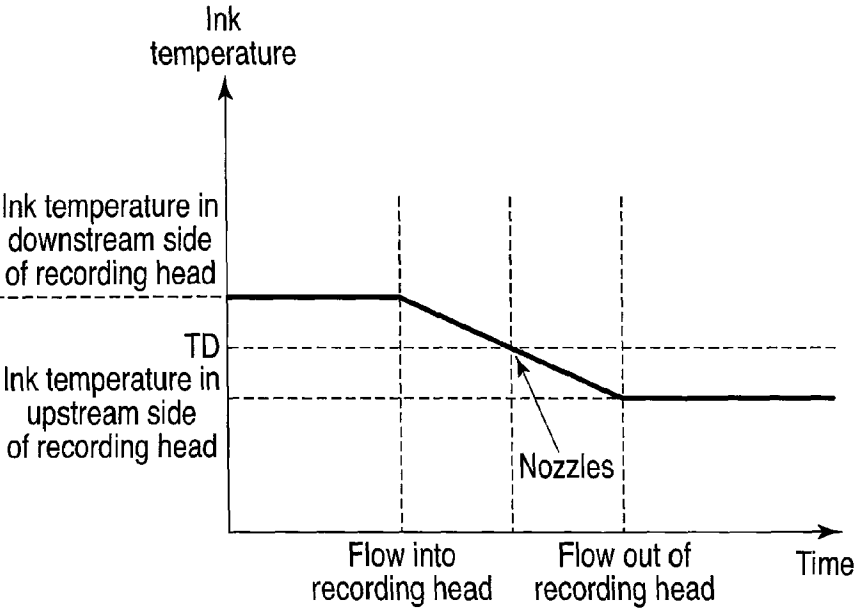
FIG. 11B (PRIOR ART)
FIG. 11A and FIG. 11B are graphs representing temperature characteristics of ink flowing through the recording head based on the prior art technique.
Figure 11A:
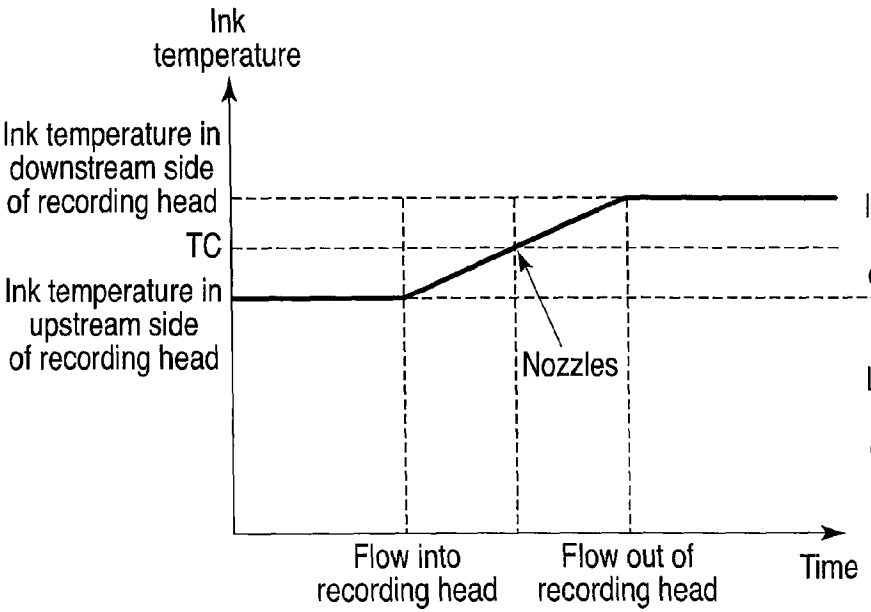
FIG. 11A (PRIOR ART)

Next, exchange of heat between ink flowing inside the heat recording head 100 and the recording head 100 will be described with reference to FIG. 8 and FIG. 9. FIG. 8 represents an example in which only ink temperatures are controlled in the present embodiment. FIG. 9 represents an example in which temperatures of the recording head 100 and ink are controlled in the present embodiment.

In FIG. 8, a case of controlling only ink temperatures will be described. The piezoelectric elements 104 are driven to perform image forming only within a range of a predetermined temperature. As an example here, a range of 15° C. to 45° C. will be described as a drivable temperature range (printable temperature range).

At first, before starting operation, ink is supposed to have a temperature of 10° C. both when a main power supply of the device is turned on and when an execution command for image forming is given. In this case, at first, both the temperature sensors 114 and 115 detect the ink temperature of 10° C.

Next, ink circulation operation is started, and the peltier element 32 is let start heating ink, to increase the temperature of ink to a drivable temperature.

Heat of the peltier element 32 is conducted through the heat exchanger 30 to ink flowing through the ink path 15.

The temperature sensor 114 attached to the ink supply port 107 measures the temperature of the heated ink, and a detected temperature increases from 10° C. However, when the ink is ejected from the ink eject port 108 after passing through the recording head 100, heat of the heated ink transfers to the drive IC through patterns formed in the base 103 and FPC 109, further to the covers 112 and 113 from the drive IC, and further to the recording head holder 200 through the fixing member 111.

As a result, a temperature of the ink detected by the temperature sensor 115 is naturally lower than the temperature detected by the temperature sensor 114. That is, the temperature of ink can be said to have been transferred to the recording head. On the contrary, if image forming is carried out sequentially, the temperature of the drive IC reaches over 50° C. In this case, run-around of the temperature to the aforementioned recording head holder 200 reaches a limit. On the contrary, heat of the drive IC 110 in addition to a temperature corresponding to heat generated by the piezoelectric elements 104 is transferred through the patterns of the FPC 109 to the ink flowing into the recording head 100. That is, the ink can be said to have been applied with heat from the recording head 100 in addition to the piezoelectric elements 104.

As has been described above, the ink which has passed through the recording head 100 is heated or cooled by environmental temperature factors dependent on periphery of the recording head (image forming apparatus) and by heat temperature factors generated by the driven recording head itself. Accordingly, with respect to temperatures of ink supplied to the piezoelectric elements 104, a temperature difference cannot be specified by only one of temperatures of the recording head 100 in inflow and outflow sides of the recording head. Therefore, a temperature at the nozzles cannot properly be estimated.

Hence, in the present embodiment, a temperature of ink flowing into the recording head 100 is detected by the temperature sensor 114, and a temperature of ink ejected from the recording head 100 is detected by the temperature sensor 115. In this manner, an average temperature between both temperatures can be taken as an estimated temperature of the temperature at the piezoelectric elements 104.

Further, improve the precision of the estimated temperature more accurate, deviation between values of the temperature sensor 114 and temperature sensor 115 need be minimized. That is, in order to surely set the temperature at the nozzles within a drivable temperature range, outputs of both the temperature sensor 114 and the temperature sensor 115 are desirably within the drivable temperature range.

The peltier element 32 controls the ink temperature of ink flowing into the recording head 100. Naturally, ink contained in the ink circulation path 1 circulates at a certain temperature or namely, with a heat capacity. Since there are limitations to heating and cooling capabilities of the peltier element 32, the ink temperature cannot instantaneously be changed to a target temperature in the inflow side of the recording head 100. The ink temperature gradually becomes close to the target temperature through repetitive circulations. In the outflow side of the recording head 100, the ink temperature depends on exchange of heat between the temperature of inflow ink and the recording head 100. In the present embodiment, a control for minimizing the aforementioned temperature difference between the temperature sensors 114 and 115 is achieved by combining the fan 201 and heater 203 provided on the recording head holder 200, with heating and cooling operations of the peltier element 32.

A further description will be made of a temperature control to the drivable temperature range, based on heating/cooling operation combined with the peltier element 32 by using fan 201 and heater 203. FIG. 10 represents examples in Cases 1 to 15 of temperature controls based on combinations of these components. FIG. 9 is a graph representing temperature characteristics in the present embodiment.

A drivable temperature range of the nozzles for form images as shown in FIG. 9, is expressed as temperatures T1 to T4, which are, for example, 15° C. to 45° C.

Image forming is possible if a temperature of the estimated nozzles (mainly the piezoelectric elements 104) is within this range. Further, as a particularly optimal control range within the temperature range, temperatures T2 to T3 are set to, for example, 25° C. to 35° C. Of course, these temperature settings are appropriately changed depending on characteristics of the recording head. In this example, the temperatures T2 to T3 are defined within the range of the temperatures T1 to T4. However, the temperature control in the present embodiment is practicable without the range of temperatures T2 to T3 although criteria may then be lax.

If a temperature of the temperature sensor 114 at the ink supply port 107 and a temperature of the temperature sensor 115 at the ink eject port 108 are both within the range of T1 to T4, there is no problem. In the following description of the embodiment, a temperature control which aims for adjusting outputs of both sensors within a narrower range of T2 to T3 within the range of T1 to T4 will be described.

In FIG. 9 and FIG. 10, the temperature detected by the temperature sensor 114 is expressed as "114", as well as the temperature detected by the temperature sensor 115 is expressed as "115". Further, in FIG. 10, $\alpha$ is a positive number and is set to 5° C. here. Of course, the numerical value of the temperature difference $\alpha$ can be changed appropriately because tolerable values vary depending on specs of the recording head.

In the examples of Cases 1 to 15, the temperatures detected by the temperature sensors 114 and 115 illustrates to be classified into three segments, i.e., a segment greater than T3 (35° C.), a segment between T2 (25° C.) and T3 (35° C.), and a segment smaller than T2 (25° C.). Symbol "○" is marked to indicate that the peltier element 32, fan 201, and, heater 203 to be controlled are driven.

Case 1:

Case 1 represents an example in which a temperature "114" of ink flowing into the recording head 100, and a temperature "115" of ink ejected from the recording head 100 are both greater than T3.

In this case, an attempt is made to decrease the detected temperature "114" of the temperature sensor 114 by driving the peltier element 32 to a cooling side so as to decrease the temperature "114" of inflow ink.

Similarly, cooling is performed by driving the fan 201 by decreasing the detected temperature "115" of the temperature sensor 115. Normally, image forming apparatuses are used in an environment at a room temperature of 35° C. or lower. Therefore, when the fan 201 is turned ON, periphery of the recording head 100 is then cooled by air, and heat is radiated from the covers 112 and 113. Accordingly, the ink temperature detected by the temperature sensor 115 is decreased.

Case 2:

Case 2 represents an ideal state for the present embodiment, in which the temperatures "114" and "115" of the temperature sensors 114 and 115 are equal to each other and are between T2 and T3. At this time, neither heating nor cooling is performed.

Case 3:

Case 3 represents an example in which the temperatures "114" and "115" are both between temperatures T2 and T3, a temperature difference over a exists between both sensors, and the temperature "114" in the inflow side is higher. In this example, the temperature "114" is cooled by the peltier element 32 so as to decrease temperatures of ink. On the other side, the heater 203 is turned on to heat the temperature "115" through the recording head holder 200 and recording head 100. By such a temperature control, a temperature difference between the temperatures "114" and "115" is decreased.

Case 4:

Case 4 represents an example in which the temperatures "114" and "115" are both between temperatures T2 and T3, the temperature "115" detected by the temperature sensor 115 is higher than the temperature "114" detected by the temperature sensor 114. A temperature difference over a exists between both sensors. In this case, a heating control is performed by the peltier element 32 so as to increase the temperature "114" of inflow ink. On the other side, the fan 201 is turned on so as to decrease the temperature "115" of ejected ink, thereby to cool recording head holder 200 and accordingly the recording head.

Case 5:

Case 5 represents an example in which the temperatures "114" and "115" are both between temperatures T2 and T3, an absolute value of the temperature difference between the temperatures "114" and "115" detected by the temperature sensor 114 and 115 is α or less. Since the temperature difference is very small, an error relative to an actual ink temperature is determined to be small even if a temperature of the nozzles is estimated by an average value between the temperatures detected by the temperature sensor 114 and 115. Therefore, neither heating nor cooling is performed. Thus, states represented by Cases 2 and 5 are ideal control states for the present embodiment.

Case 6:

Case 6 represents an example in which the temperature "114" detected by the temperature sensor 114 is within a target temperature range while the temperature "115" detected by the temperature sensor 115 is lower than T2. In this case, the temperature "115" of ink ejected from the recording head 100 is low, and therefore, the heater 203 is turned on to heat the recording head 100 on the recording head holder 200. A control is performed so as to transfer heat from the recording head 100 to ink.

Case 7:

Case 7 represents an example in which the temperature "115" detected by the temperature sensor 115 is within a target temperature range while the temperature "114" detected by the temperature sensor 114 is low. In this case, the peltier element 32 is subjected to a heating control thereby to increase the temperature "114" of ink flowing into the recording head 100. In Cases 6 and 7, symbol "*" in FIG. 10 indicates that whether temperatures are to be totally increased or decreased is determined by an ink temperature at the nozzles estimated by average temperature using the temperatures "114" and "115" detected by the temperature sensors 114 and 115.

For example, in Case 6, if an estimated value is lower than T2 (25° C.), the estimated value is not within the most suitable temperature range, and the ink temperature need to be increased much more. Therefore, even if the temperature of the temperature sensor 114 is T2 or more, the peltier element 32 is subjected to a heating control. On the other side, if the estimated value is between T2 and T3, the temperature "115" detected by the temperature sensor 115 is too low, and the heating control of the peltier element 32 is not carried out. Also in Case 7, if the estimated value is lower than T1, the ink circulation path 1 and recording head holder 200 are determined to be in a state of low temperature, and therefore, the heater 203 is driven to perform heating.

Case 8:

Case 8 represents an example in which the temperatures "114" and "115" detected by the temperature sensors 114 and 115 are both lower than T2. In this case, a heating control by the peltier element 32 and heating by the heater 203 are both performed.

Case 9:

Case 9 represents an example in which the temperature "114" of ink flowing into the recording head is higher than T3 and is higher than the temperature "115" of ejected ink, a temperature difference exceeds α, and a case in which an average value between the temperatures "114" and "115" are between T2 and T3. In this case, the peltier element 32 is subjected to a cooling control, thereby to decrease the temperature "114". In Case 9, the symbol "*" indicates a case in which an average value between the temperatures "114" and "115" detected by the temperature sensors 114 and 115 exceeds T3. A temperature of the whole ink circulation path 1 is determined to be high, and the fan 201 is therefore driven to cool air in the periphery of the recording head 100, thereby to decrease the temperature of circulating ink.

Case 10:

Case 10 represents an example in which an absolute value of the temperature difference between the temperatures "114" and "115" detected by the temperature sensor 114 and 115 is α or less. In this case, the same temperature control as in Case 9 is performed.

Case 11:

Case 11 represents that the temperature "114" detected by the temperature sensor 114 is higher than T3 while the temperature "115" detected by the temperature sensor 115 is lower than T2. Normally, such a case as described above hardly occurs. However, in such a case, the peltier element 32 is subjected to a cooling control, to decrease the temperature "114" of ink flowing into the recording head 100. And the heater 203 is driven to heat the periphery of the recording head 100. Then the temperatures "114" and "115" are controlled between T2 and T3.

Case 12:

Case 12 represents an example in which the temperature "115" detected by the temperature sensor 115 is higher than T3, the temperature "114" detected by the temperature sensor 114 is between T2 and T3, and a temperature difference obtained by subtracting "114" from "115" exceeds α. In this case, the fan 201 is driven to cool air in the periphery of the recording head 100, thereby to decrease the temperature "115". If an average value calculated with the temperatures "114" and "115" is higher than T3, the whole device is determined to be hot, and a cooling control is performed by the peltier element 32 as marked with "*".

Case 13:

Case 13 represents an example in which the temperature "115" detected by the temperature sensor 115 is higher than T3, the temperature "114" detected by the temperature sensor 114 is between T2 and T3, and a temperature difference between the temperatures "114" and "115" is α or less. In this case, the fan 201 is driven to cool air in the periphery of the recording head 100. If a calculated average value is higher than T3, the whole device is determined to be hot, and the peltier element 32 is subjected to a cooling control as marked with "*".

Case 14:

Case 14 represents an example in which the temperature "115" of ink ejected from the recording head 100 exceeds T3, and the temperature "114" of ink flowing in is lower than T2. Normally, this example also hardly occurs. However, the peltier element 32 is subjected to a heating control thereby to increase the temperature of ink flowing into the recording head 100, with the fan 201 is driven to a cooling control to subject the periphery of the recording head 100.

Case 15:

Case 15 represents an example in which the temperature "115" detected by the temperature sensor 115 is between T2 and T3 while the temperature "114" detected by the temperature sensor 114 in the ink inflow side is lower than T2. In this case, the peltier element 32 is subjected to a heating control. The symbol "*" marked in the figure indicates that if a calculated average value is lower than T2, the heater 203 is driven.

Thus, cooling and/or heating is performed on a corresponding constitutive portion in order to produce ideal temperature states depending on situations of Cases 1 to 15 which are classified based on an environmental temperature and temperatures detected by the temperature sensors 114 and 115.

For example, a case of turning on the power supply or starting image forming at an environmental temperature of 10° C. belongs to Case 8, and the temperatures "114" and "115" are both lower than T2. Therefore, the peltier element 32 is subjected to a heating control, and heating is performed by the heater 203. Thus, ink heated by the peltier element 32 through a control as described above flows from the upstream sub-tank 50 and passes through the ink feed path 14 and ink supply port 107. The ink further flows into the recording head 100, reaches the piezoelectric elements 104 of the nozzles, and further flows out of the ink eject port 108. At this time, the recording head 100 is heated by the heater 203 through the recording head holder 200. Therefore, the temperature of the ink is not radiated to the side of the recording head.

Accordingly, the state transits to that of Case 6 or 15 after elapse of a certain time period. Upon elapse of a further time period, the state finally transits to that of Case 2 or 4, and the temperature difference between the temperature sensor 114 and 115 is controlled to until the temperature difference becomes slight.

Further, in comparison with an example of controlling only ink temperatures by the peltier element 32 represented in FIG. 8, the temperature of the recording head 100 is controlled simultaneously together in the present embodiment, as illustrated in FIG. 9. The temperature at the nozzles (at the part of piezoelectric elements 104), which is estimated from an average value between the temperatures detected by the temperature sensors 114 and 115 instantaneously reaches T1. That is, if the estimated temperature of the nozzles is lower than T1, for example, before starting driving, a warm-up indication is displayed, in normal cases, and a standby period starts. Image forming cannot be started before the indication disappears. However, in the present embodiment, it reaches at T1 instantaneously. Accordingly, the state transits to a start state for image forming within a short time, and operation can then be started.

In this control of shortening the standby period, the temperature is controlled to be turned on/off, targeting the temperature of the temperature sensor 114. A control as follows is continued for the heater 203. That is, the heater 203 is turned off when the temperature of the temperature sensor 115 reaches the temperature of the temperature sensor 114. The heater 203 is turned on when the temperature of the temperature sensor 115 becomes lower than the temperature of the temperature sensor 114 again. By performing controls in this manner, deviation between the temperature sensors 114 and 115 can be constantly maintained small, and whether an average temperature calculated from both sensors reaches T1 or not can be determined accurately.

Alternatively, if temperatures are totally high as in Cases 1, 12, and 13, the entire device has already been warmed up, for example, by continuous driving, and the drive IC 110 inside the recording head has already reached at considerably high temperature. In the foregoing examples, there is no means for detecting the temperature, and the fan 201 was constantly driven throughout driving.

Depending on a determination from values of the temperature sensors 114 and 115, a substantial temperature of the recording head 100 is estimated, and the fan 201 is driven in accordance with respective classifications of Cases represented in FIG. 10. In this manner, excessive cooling by the fan 201 is prevented, and the temperature of the piezoelectric elements 104 is avoided from becoming lower than T1 or T2, and quality of formed images is prevented from deteriorating.

Even if a temperature estimated on the basis of actually measured values is between T2 and T3 as control targets, as in Cases 3, 4, and 5, there is a case that the detected temperatures of the temperature sensors 114 and 115 exceed 5° C. In this case, the peltier element 32, fan 201, and heater 203 are subjected to a drive control, respectively classified into the aforementioned Cases. As a result, by maintaining the temperature difference to be constantly small, then an error of an estimated (calculated) temperature of ink flowing through the piezoelectric elements 104 can be reduced.

Next, a first modification will be described.

In the embodiment described above, the heater 203 is used to heat the recording head. However, a different heat generation source is used in the modification.

The heater 203 described above is provided so as to prevent heat from being radiated from ink flowing inside the recording head to the recording head holder 200, by heating the recording head. The modification is an example in which the drive IC 110 is used as a heat generation source for heating the recording head 100. Specifically, the drive IC 110 is driven to vibrate the piezoelectric elements 104 to an extent at which ink is not fired. This vibration is a drive waveform (a unfiring waveform) which does not cause ejection from the nozzles 101*b* but used for driving the piezoelectric elements 104 only.

Thus, such a unfiring waveform is used for driving although a firing waveform is used during image forming. About 90% of power consumed by the recording head 100 at this time is changed into heat generated by the drive IC 110. The remaining 10% thereof becomes heat through the piezoelectric elements 104. Since such heat is generated, the heat generated by the drive IC 110 and piezoelectric elements 104 is transferred to the base 103, fixing member 110, and recording head covers 112 and 113 when ink heated by the peltier element 32 passes through the recording head 100. Therefore, heat is hardly radiated from ink, that is, the same effects as obtained by the heater 203 can be obtained.

However, in this modification, heat generation is caused by driving of the drive IC 110. Therefore, independent heating operation as achieved by the heater 203 cannot be achieved. Accordingly, heating operation is available only within time in which the drive IC 110 can be driven by sending an undischarged waveform. For example, the modification is practicable at timings such as a waiting time until image forming is started, intervals between job processings, and intervals between cut paper sheets.

In the modification, a temperature control for ink is performed by the peltier element 32, and a temperature control for periphery of the recording head 100 are performed by the fan 201 and the heater 203 or the piezoelectric elements 104 which are driven by the drive IC 110 apply to the undischarged waveform. As an alternative means, the recording head holder 200 may be provided with a further peltier element. Heating/cooling means according to the invention are not limited to those described above.

Further, the present embodiment has been described with a configuration example in which the ink supply port 107 and ink eject port 108 in the recording head are respectively provided with the temperature sensors 114 and 115. The sensors may be provided in the upstream and downstream sides relative to the nozzles (piezoelectric elements) of the recording head as a substantial center, along an ink path through which ink is circulated. Positions of the sensors are not limited by attachment thereof to the ports 107 and 108.

In the present embodiment, the control marked with "*" in Cases 6, 7, 9, 10, 12, and 13 is performed depending on whether an estimated ink temperature of ink flowing through the nozzles 101*b* is within a range of T2 to T3 as an optimal temperature control range. For example, the temperature of the nozzles (piezoelectric elements 104) can be surely established between T1 and T4 by performing a control in a manner that the temperatures detected by the temperature sensors 114 and 115 are both within a range of T1 to T4. Further, a control is performed so as to reduce deviation between output values of the sensors. Therefore, the temperature of the nozzles can be estimated with good accuracy.

In the embodiment described above, a method of using piezoelectric elements is employed as an example of a discharging method for the recording head. The discharging method is not particularly limited but the same effects can be attained by employing a thermal method.

In the image forming apparatus according to the embodiment of the invention as described above, temperatures of ink circulating through an ink circulation path are detected in upstream and downstream sides with the nozzles intervening therebetween. A temperature control is performed by heating/cooling so that both detected values fall within a drivable temperature range. A temperature of nozzles can accordingly be surely adjusted to be within the drivable temperature range. Even when both of the temperatures detected by the temperature sensors 114 and 115 are within the drivable temperature range, the temperature control is performed so as to reduce a temperature difference between the sensors is reduced. Therefore, the temperature of the nozzles can be estimated with more accuracy. As a result, a constant amount of ink to be discharged can be stably discharged.

When values of both sensors are adjusted to be within the drivable range, a temperature control for ink and a temperature control for the recording head are performed together. In this manner, the values can be rapidly adjusted to a target temperature. In the present embodiment, the temperatures T2 to T3 are defined within the range of temperatures T1 to T4. However, the temperature control in the present embodiment is practicable without the temperatures T2 to T3 although criteria may be lax.

Therefore, according to the present invention, there can be provided an image forming apparatus capable of forming high quality images on recording media by estimating an ink temperature at nozzles in a recording head with improved high accuracy and by accordingly optimizing amount of ink volume to be fired from the recording head.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus comprising:

a recording head comprising a plurality of nozzles which discharge ink;

a circulation path which comprises a feed path for feeding ink to the recording head and a eject path for ejecting the ink from the recording head, and feeds the ink flowing through the eject path again to the recording head through the feed path;

a first temperature detection section provided in a side of the feed path;

a second temperature detection section provided in a side of the eject path; and ink temperature adjustment means which controls temperatures of the ink;

wherein the ink temperature adjustment means calculates an ink temperature at the nozzles, based on an output from the first temperature detection section and an output from the second temperature detection section, and adjusts ink temperatures such that the calculated ink temperature falls within a temperature range in which the ink can be discharged;

wherein the ink temperature adjustment means adjusts the ink temperatures such that the outputs from the first and second temperature detection sections both fall within the temperature range in which the ink can be discharged; and wherein the ink temperature adjustment means comprises:

a first temperature adjustment section which controls a temperature of the ink flowing through the feed path; and a second temperature adjustment section which controls a temperature of the ink flowing through the eject path;

wherein:

the ink temperature adjustment means adjusts the ink temperature of the ink flowing through the feed path by using the first temperature adjustment section so that the output from the first temperature detection section falls within the temperature range in which the ink can be discharged; and the ink temperature adjustment means adjusts the ink temperature of the ink flowing through the eject path by using the second temperature adjustment section such that the output from the second temperature detection section falls within the temperature range in which the ink can be discharged.

2. The image forming apparatus according to claim 1, wherein the ink temperature adjustment means adjusts the ink temperatures so that the outputs from the first and second temperature detection sections are equal to each other.

3. The image forming apparatus according to claim 1, wherein the ink temperature adjustment means adjusts the ink temperatures such that the outputs from the first and second temperature detection sections both fall within another temperature range in which the ink is stably discharged, the another temperature range being set within and narrower than the temperature range in which the ink can be discharged.

4. An image forming apparatus comprising:

a recording head comprising a plurality of nozzles which discharge ink;

a circulation path which comprises a feed path for feeding ink to the recording head and a eject path for ejecting the ink from the recording head, and feeds the ink flowing through the eject path again to the recording head through the feed path;

a first temperature detection section provided in a side of the feed path;

a second temperature detection section provided in a side of the eject path; and ink temperature adjustment means which controls temperatures of the ink;

wherein the ink temperature adjustment means calculates an ink temperature at the nozzles, based on an output from the first temperature detection section and an output from the second temperature detection section, and adjusts ink temperatures such that the calculated ink temperature falls within a temperature range in which the ink can be discharged;

wherein the ink temperature adjustment means adjusts the ink temperatures such that the outputs from the first and second temperature detection sections both fall within the temperature range in which the ink can be discharged; and wherein the ink temperature adjustment means comprises:

a first temperature adjustment section which controls a temperature of the ink flowing through the feed path; and a second temperature adjustment section which controls a temperature of the ink flowing through the eject path;

wherein the outputs from the first and second temperature detection sections are compared with each other, and the ink temperature of the ink flowing through the feed path is decreased by using the first temperature adjustment section and the ink temperature of the ink flowing through the eject path is increased by using the second temperature adjustment section, if the output from the first temperature detection section is higher than the output from the second temperature detection section.

5. An image forming apparatus comprising:

a recording head comprising a plurality of nozzles which discharge ink;

a circulation path which comprises a feed path for feeding ink to the recording head and a eject path for ejecting the ink from the recording head, and feeds the ink flowing through the eject path again to the recording head through the feed path;

a first temperature detection section provided in a side of the feed path;

a second temperature detection section provided in a side of the eject path; and ink temperature adjustment means which controls temperatures of the ink, wherein the ink temperature adjustment means calculates an ink temperature at nozzles, based on an output from the first temperature detection section and an output from the second temperature detection section, and adjusts ink temperatures such that the calculated ink temperature falls within a temperature range in which the ink can be discharged, wherein the ink temperature-adjust means adjusts ink temperatures such that the outputs from the first and second temperature detection sections both fall within the temperature range in which the ink can be discharged, and wherein the ink temperature adjustment means comprises:

a first temperature adjustment section which controls a temperature of the ink flowing through the feed path; and a second temperature adjustment section which controls a temperature of the ink flowing through the eject path;

wherein the outputs from the first and second temperature detection sections are compared with each other, and the ink temperature of the ink flowing through the feed path is increased by using the first temperature adjustment section and the ink temperature of the ink flowing through the eject path is decreased by using the second temperature adjustment section, if the output from the second temperature detection section is higher than the output from the first temperature detection section.

* * * * *